United States Patent [19]

Fukuroi

[11] 3,952,379

[45] Apr. 27, 1976

[54] AUTOMATICALLY LOCKING SLIDER

[75] Inventor: Takeo Fukuroi, Uozu, Japan

[73] Assignee: Yoshida Kogyo Kabushiki Kaisha, Japan

[22] Filed: Dec. 20, 1974

[21] Appl. No.: 535,103

[30] Foreign Application Priority Data

Dec. 29, 1973 Japan ..... 49-4185[U]

[52] U.S. Cl. ..... 24/205.14 R

[51] Int. Cl.[2] ..... A44F 19/30

[58] Field of Search ..... 24/205.14 R, 205.14 K

[56] References Cited

UNITED STATES PATENTS

| | | | |
|---|---|---|---|
| 2,657,445 | 11/1953 | Weber | 24/205.14 |
| 2,799,070 | 7/1957 | Weber | 24/205.14 K |
| 2,913,795 | 11/1959 | Brown | 24/205.14 R |
| 2,978,772 | 4/1961 | Brown | 24/205.14 R |
| 2,993,253 | 7/1961 | Carlile | 24/205.14 R |
| 3,016,592 | 1/1962 | Manning | 24/205.14 R |
| 3,038,226 | 6/1962 | Kedzierski | 24/205.14 R |
| 3,038,228 | 6/1962 | Carlile | 24/205.14 R |
| 3,045,307 | 7/1962 | Pouy | 24/205.14 R |
| 3,129,480 | 4/1964 | Carlile | 24/205.14 K |

FOREIGN PATENTS OR APPLICATIONS

| | | | |
|---|---|---|---|
| 230,025 | 8/1960 | Australia | 24/205.14 R |
| 821,650 | 10/1959 | United Kingdom | 24/205.14 R |

*Primary Examiner*—Bernard A. Gelak

*Attorney, Agent, or Firm*—Bucknam and Archer

[57] ABSTRACT

An automatic slider lock mechanism including a locking leaf spring arranged longitudinally over the top wing of the slider body and having one end secured to the flared front end of the slider body. A locking pawl formed at the other end of the locking leaf spring yieldably projects into the guide channel in the slider body through an aperture formed in its top wing, the locking pawl retracting from the guide channel when a pull is exerted on the pull tab of the slider. The locking leaf spring has a pair of shoulders engaged by a pair of transversely spaced spring retainers on the top wing of the slider body, and an elongate neck extending forwardly from the shoulders through the spacing between the spring retainers.

3 Claims, 4 Drawing Figures

AUTOMATICALLY LOCKING SLIDER

BACKGROUND OF THE INVENTION

This invention relates generally to slide fasteners and in particular to an automatically locking slider for slide fasteners. Still more particularly, the invention concerns an automatic slider lock mechanism of the type including a leaf spring with a locking pawl at one end thereof which normally projects into the guide channel in the slider body to lock the slider against movement on a pair of fastener stringers and which retracts therefrom to unlock the slider when a pull is exerted on the pull tab of the slider.

In the automatic slider lock mechanism of the above defined type, the locking leaf spring has heretofore been supported substantially at its mid-point by suitable means mounted more or less centrally on the top wing of the slider body with respect to its longitudinal dimension. According to this prior art arrangement, the locking leaf spring is relatively easy to be displaced or deformed when twisted by the application of crosswise pulling forces to the pull tab. The mechanism will then be unable to lock the slider properly on a pair of fastener stringers.

The prior art slider lock mechanism is also objectionable in that the curved portion of its locking leaf spring, which portion is the principal part lending the desired resiliency to the spring, is located too close to the point on the locking leaf spring where the pull tab of the slider is pivotally connected thereto. The curved spring portion thus arranged with respect to the slider pull tab is directly subjected to high stresses resulting from the exertion of endwise or crosswise pulling forces on the pull tab. This can significantly shorten the service life of the locking leaf spring and of the slider itself.

SUMMARY OF THE INVENTION

In view of the noted drawbacks of the prior art, it is an object of this invention to provide a slider having an improved automatic lock mechanism for slide fasteners which is simple and endurable in construction, positive in operation, and economical of manufacture.

Another object of the invention is to provide an automatic slider lock mechanism including a locking leaf spring which is so configured and arranged with respect to the body and the pull tab of the slider that it will serve its intended purposes efficiently in spite of the various stresses that may be applied thereto throughout the life expectation of the slide fastener.

With these objects in view and the other objects hereinafter set forth, this invention provides, in a fastener slider of the well known type, an automatic lock mechanism including a locking leaf spring arranged longitudinally over the top wing of the slider body and having one end secured to the front end of the slider body, in such a manner that the locking leaf spring is yieldably urged against the slider body. The locking leaf spring comprises a pair of shoulders intermediate both ends thereof which are adapted to be engaged by a pair of spring retainers, respectively, projecting upwardly from the top wing of the slider body, an elongate neck extending between the shoulders and the said one end thereof, and a locking pawl at the other end of the leaf spring which normally projects into the slider body to engage the rows of interlocking fastener elements along which the slider is intended to move to open or close the fastener. The pull tab of the slider surrounds at one end the locking leaf spring at its portion between the shoulders and the locking pawl, in such a manner that the locking pawl retracts from within the slider body only when a pull is being exerted on the pull tab.

The features which are believed to be novel and characteristic of this invention are set forth in particular in the claims appended hereto. The invention itself, however, both as to its construction and mode of operation, together with the further objects and advantages thereof, will become apparent from the following description taken in conjunction with the accompanying drawings which illustrate, by way of example only, a preferred embodiment of the invention and in which like reference characters denote like parts throughout the several views.

DESCRIPTION OF THE PREFERRED EMBODIMENT

Figure 1:
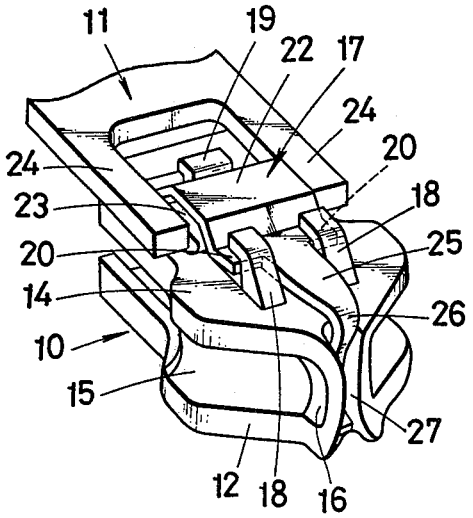
FIG. 1 is a perspective view of an automatically locking slider for slide fasteners constructed in accordance with the novel concepts of this invention, in which the pull tab is shown fragmentarily to facilitate the illustration.
Figure 3:
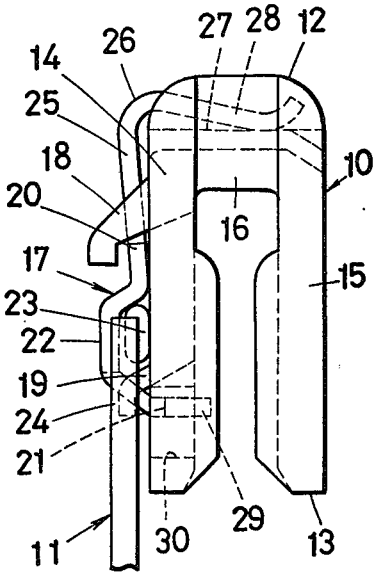
FIG. 3 is the right hand slide elevational view of the slider as shown in FIG. 2.
Figure 2:
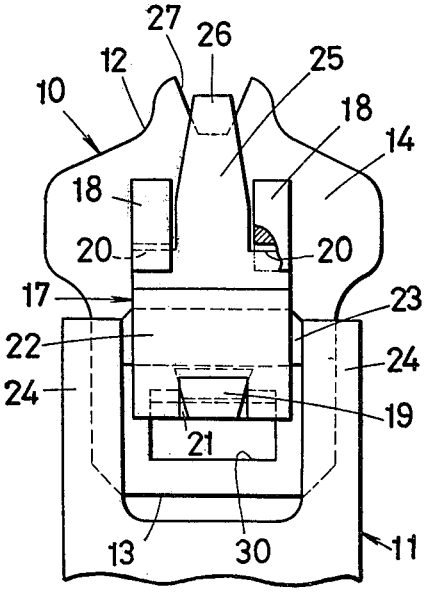
FIG. 2 is a top plan view of the slider shown in FIG. 1.

The slider body 10 has a flared front end 12 and a contracted rear end 13 and is composed of a top wing 14 and a bottom wing 15 which are interconnected by a web 16 located centrally at the flared front end 12. The usual Y-shaped guide channel is thus formed through the slider body 10 to permit rows of interlocking fastener elements, not shown, to pass therethrough as the slider is moved along the fastener elements to open or close the slide fasteners.

The automatic lock mechanism according to the invention includes a locking leaf spring 17 generally arranged longitudinally over the top wing 14 of the slider body 10. Projecting upwardly from the top wing 14 of the slider body 10 are a pair of transversely spaced spring retainers 18, which are located rather closer to the flared front end 12 of the slider body than to its contracted rear end, and a stop 19 which is located centrally adjacent the contracted rear end of the slider body. The locking leaf spring 17 is operatively mounted on the top wing 14 by having its pair of shoulders 20, formed intermediate both ends thereof, held under the respective spring retainers 18 and by relatively loosely receiving the stop 19 in an aperture 21 formed adjacent the rear end of the leaf spring.

The locking leaf spring 17 has a raised portion 22 between its shoulders 20 and aperture 21. There is arranged between this raised portion 22 of the locking leaf spring 17 and the top wing 14 of the slider body 10 a relatively flat pin 23 extending between a pair of prongs 24 at the bifurcated end of the pull tab 11.

The locking leaf spring 17 has an elongate neck 25 extending forwardly of the shoulders 20 and arranged between the pair of spring retainers 18. The neck 25 has a curved portion 26, which is the principal part imparting the desired resiliency to the locking leaf spring 17, located centrally at the flared front end 12 of the slider body 10 and extends downwardly therefrom into a groove 27 formed in the web 16 of the slider body. The front end portion 28 of the locking leaf spring is clamped and securely retained in the groove 27, in such a manner that the leaf spring is urged against the slider body 10.

At its rear end the locking leaf spring 17 terminates in a locking pawl 29 which projects downwardly into the guide channel of the slider body 10 via an aperture 30 formed in its top wing 14. The locking leaf spring 17 as a whole is so mounted on the slider body 10 that the locking pawl 29 is biased downwardly into the guide channel of the slider body.

Figure 4:
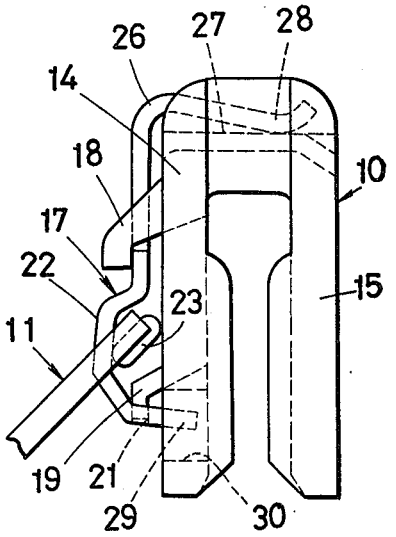
FIG. 4 is a view similar to FIG. 3 but explanatory of the way the slider is unlocked upon exertion of a pull on its pull tab.

Thus, when a pull is exerted on the pull tab 11 surrounding the locking leaf spring 17 at one end thereof to move the slider along the rows of fastener elements in either direction, as illustrated in FIG. 4, the pin 23 of the pull tab becomes held at a certain angle to the plane of the top wing 14 of the slider body 10. With the raised portion 22 of the locking leaf spring 17 thus lifted away from the top wing 14, the locking pawl 29 at its rear end retracts from the guide channel of the slider body 10 into the aperture 30. The slider, now unlocked, is free to move along the rows of fastener elements as long as there is a pull on the pull tab 11. When the pull tab is released, the locking pawl 29 again projects into the guide channel of the slider body to engage the fastener elements and hence to lock the slider in the desired position on the pair of fastener stringers.

The upward motion of the locking pawl 29, when a pull is exerted on the pull tab 11, is limited by the stop 19 received in the aperture 21 of the locking leaf spring 17. The mid-portion of the locking leaf spring 17 is also prevented from being lifted too far away from the slider body 10 by the pair of spring retainers 18 engaging the respective leaf spring shoulders 20.

It is particularly noteworthy that the locking leaf spring 17 of the improved automatic slider lock mechanism according to the invention will definitely maintain its correct attitude on the slider body 10 even when strong torsional or crosswise forces are applied to the slider pull tab 11, because the spring is supported by and between the pair of spring retainers 18 practically against any possibility of twisting or of lateral displacement.

Furthermore, since the curved spring portion 26 is located adjacent the distal end of the elongate neck 25 extending from the pair of shoulders 20 which are engaged by the respective spring retainers 18, this curved portion is to be stressed by no greater pulling force exerted on the slider pull tab 11 than that necessary to cause the locking pawl 29 to retract to a desired degree out of the guide channel of the slider body. It will therefore be seen that the spring retainers 18 also serve to protect the curved spring portion 26 from the effects of any unnecessarily great pull on the slider pull tab 11.

The slider equipped with the automatic lock mechanism according to the invention will therefore function efficiently for an extended length of time in spite of the possible severe working conditions to which it may be subjected in the use of the complete slide fastener.

Having thus described the invention, it is clear that the objects as stated above, either explicitly or otherwise, have been accomplished in a simple and practical manner. However, while the invention has been shown and described herein in terms of but one of its various possible adaptations, it is to be understood that changes may be made in the construction and arrangements of the various parts without departing from the spirit and scope of the invention as expressed in the following claims.

What is claimed is:

1. In a slide fastener slider of the type having a single pull tab and a body, said slider body including a top wing and a bottom wing which are interconnected by a web located centrally at its front end to define a generally Y-shaped guide channel therethrough, an automatic lock mechanism comprising, in combination, a locking leaf spring generally arranged longitudinally over said top wing of said slider body and having one end adjacent to and secured to said front end of said slider body in such a manner that said locking leaf spring is yieldably urged against said slider body, said locking leaf spring having a widened portion and an elongate neck extending from said widened portion toward said one end thereof, said widened portion and a portion of said neck adjacent thereto being coplanar, and forming a pair of shoulders at both sides of said neck, a pair of spring retainers projecting upwardly from said top wing of said slider body to engage said shoulders, respectively, of said locking leaf spring so that said neck of said locking leaf spring is at least partly arranged between said spring retainers, said spring retainers extending over the top surface of said widened portion at said shoulders, and a locking pawl at the other end of said locking leaf spring, said locking pawl normally projecting into said guide channel in said slider body through an aperture formed in said top wing, said locking leaf spring further including a portion between said shoulders and said locking pawl which portion is disposed to enclose a part of said pull tab in such a manner that when a pull is exerted on said pull tab, said locking leaf spring is generally raised away from said slider body whereby said locking pawl retracts from said guide channel in said slider body.

2. An automatic lock mechanism as set forth in claim 1, wherein said locking leaf spring has a curved portion adjacent said one end thereof, said curved portion being located centrally at said front end of said slider body, and wherein said one end of said locking leaf spring is securely retained within a groove formed in said web of said slider body.

3. An automatic lock mechanism as set forth in claim 1, further including means for limiting the retracting motion of said locking pawl from said guide channel of said slider body when a pull is exerted on said pull tab, said means including a stop projecting upwardly from said top wing of said slider body and received in an aperture formed in said locking leaf spring adjacent said other end thereof.

* * * * *